US005975752A

United States Patent [19]

Doerksen

[11] Patent Number: 5,975,752

[45] Date of Patent: Nov. 2, 1999

[54] FABRICATED STEEL LIFTER FOR ROTARY KILN

[75] Inventor: Brian J. Doerksen, Sulphur, La.

[73] Assignee: Conoco Inc., Ponca City, Okla.

[21] Appl. No.: 09/030,630

[22] Filed: Feb. 25, 1998

[51] Int. Cl.[6] ..... F27B 7/16

[52] U.S. Cl. ..... 366/228; 432/118

[58] Field of Search ..... 366/22–25, 56–58, 366/225, 226, 228; 34/135–137; 432/118

[56] References Cited

U.S. PATENT DOCUMENTS

| | | | |
|---|---|---|---|
| 2,553,464 | 5/1951 | McNeill . | |
| 2,959,869 | 11/1960 | Ackerman | 366/228 |
| 4,172,701 | 10/1979 | Bernt | 34/135 |
| 4,175,335 | 11/1979 | Avril | 366/228 |
| 4,189,300 | 2/1980 | Butler | 432/118 |
| 4,293,228 | 10/1981 | Swisher, Jr. et al. | 366/57 |
| 4,668,183 | 5/1987 | Patterson | 432/118 |
| 4,802,139 | 1/1989 | Sasaki | 366/25 |
| 5,033,863 | 7/1991 | Linkletter | 366/228 |
| 5,197,205 | 3/1993 | Spada et al. | 34/135 |
| 5,203,693 | 4/1993 | Swanson | 432/118 |
| 5,480,226 | 1/1996 | Milstead | 366/228 |
| 5,515,620 | 5/1996 | Butler | 366/57 |

FOREIGN PATENT DOCUMENTS

| | | | |
|---|---|---|---|
| 427235 | 3/1926 | Germany | 34/137 |

*Primary Examiner*—Charles E. Cooley

[57] ABSTRACT

A fabricated steel lifter for enhancing mixing of particulate material in a rotary calcining kiln. The lifter is fabricated from a weldable heat resistant alloy and includes a base plate, an anchor post, a sole plate, a face plate attached to the sole plate and extending back over the anchor post, and supporting gussets between the sole plate and the face plate.

5 Claims, 2 Drawing Sheets

FABRICATED STEEL LIFTER FOR ROTARY KILN

FIELD OF THE INVENTION

This invention relates to rotary calcining kilns, and more particularly to improved mixers or lifters in such kilns for mixing particulate material as it moves through the kiln.

BACKGROUND OF THE INVENTION

Rotating calcining kilns are utilized for calcining various materials including so-called green coke. Particulate green coke is fed into one end of an inclined rotating generally cylindrical kiln, and burners near the discharge end of the kiln provide heat for transforming green coke into calcined coke as the coke moves through the calciner. In order to obtain uniformity in calcining, it is conventional to provide lifters (mixers) in at least part of the calciner interior. The calciner interior typically is lined with refractory material to protect the calciner shell from the high calcining temperature. Mixers comprised of reinforced refractory material are typically located in a pattern on the calciner interior. These mixers project into the kiln interior beyond the surface of the refractory lining and assist in the mixing and tumbling of the particulate material being calcined, resulting in a more uniformly calcined material than would be obtained in the absence of the mixers.

Mixers formed of refractory material are satisfactory up to a point, but over a period of several months to one or two years these mixers degrade by spalling and crumbling, resulting in reduced calcining efficiency between shutdowns for repair. In the past, when calciners have been shut down for scheduled maintenance, repair of refractory mixers has been required.

BACKGROUND ART

In addition to the refractory mixers discussed above, a cast metal lifter is available from Fuller Mineral Processing, Inc. of Bethlehem, Pa. This lifter includes a rather complex anchoring system including multiple support posts extending through the kiln shell.

SUMMARY OF THE INVENTION

According to the present invention, a fabricated steel lifter is provided for replacement of the conventional refractory mixer. The steel lifter is adapted for attachment to the kiln shell, and is configured to effectively mix the kiln contents and to have a longer life than refractory mixers.

Accordingly, it is an object of the invention to overcome the deficiencies of refractory mixers in rotary calcining kilns. It is a further object to provide a mixer that can be easily fabricated and installed, and that will be much more durable than existing mixers.

THE DRAWINGS

DESCRIPTION OF THE PREFERRED EMBODIMENT

Figure 2:
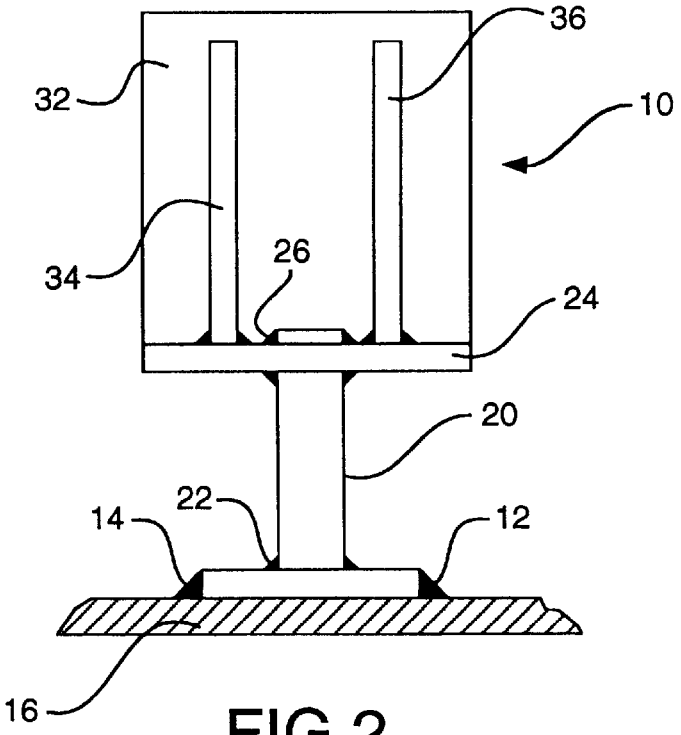
FIG. 2 is a rear elevation, partially cut away, showing a fabricated lifter in accordance with the invention.
Figure 3:
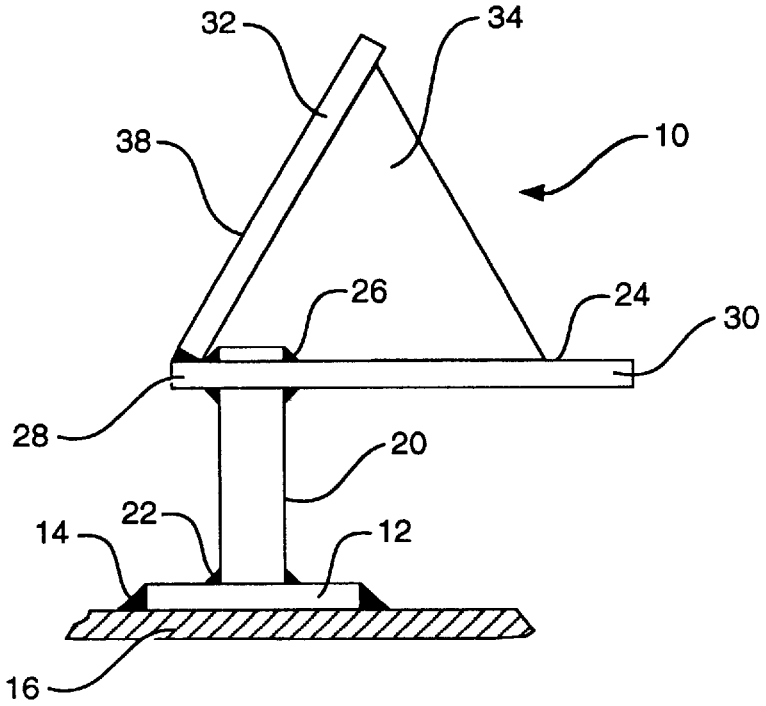
FIG. 3 is a side elevation, partially cut away, showing a fabricated lifter in accordance with the invention.
Figure 4:
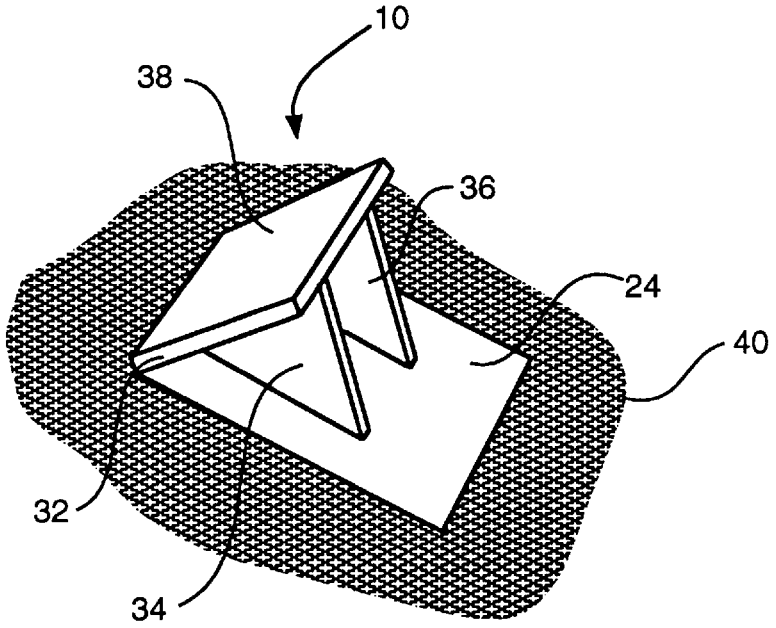
FIG. 4 is a perspective view showing a fabricated lifter in accordance with the invention.

As seen in FIGS. 2, 3, and 4, a fabricated lifter shown generally at 10 includes a base plate 12 attached by welds 14 to kiln shell 16. Base plate 12 includes a vent hole (not shown) for preventing gas pressure build up under base plate 12. An anchor post 20 is affixed to base plate 12 by welds 22, and extends into the kiln interior, preferably just past the thickness of the refractory lining of the kiln shell.

A sole plate 24 is attached to anchor post 20 by welds 26, and includes a shorter section 28 and a longer section 30.

A face plate 32 is attached to the short section of the sole plate 28 by welds 34, and extends at an incline back over anchor post 20.

A pair of gussets 34 and 36 in the shape of triangular plates are affixed to sole plate 24 and face plate 32 to provide rigidity and support to the lifter, particularly to the face plate 32.

As seen best in FIG. 2, gussets 34 and 36 are positioned outside the diameter of anchor post 20 and in combination with face plate 32 provide protection from radiant heat for the connection of the anchor post to the sole plate.

As seen in FIG. 4, the sole plate 24 overlies refractory material 40 lining the interior of the kiln.

It will be apparent that variations from the structure shown in FIGS. 2 and 3 could be utilized. For example, the acute angle between the face plate and sole plate could be more or less than as shown, and the shape of the various segments of the lifter could be changed. For example, the face plate could have a plow shape to enhance mixing of the kiln contents.

The lifter of this invention is fabricated from a weldable alloy suitable for high temperature service. A preferred alloy composition for the lifter is a nickel-based alloy comprising about 45 percent nickel, 25 percent chromium, 18 percent iron, 1.25 percent silicon and 3 percent each of molybdenum, columbium and tungsten.

Operation

Figure 1:
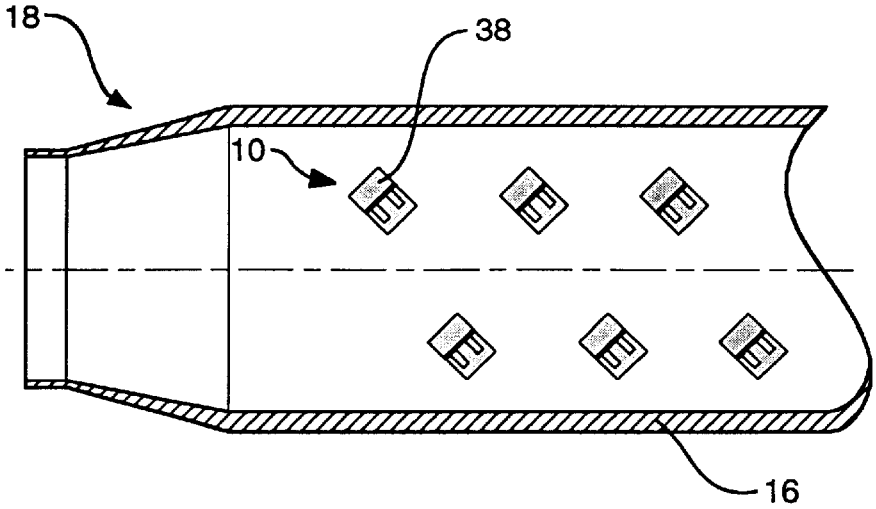
FIG. 1 is a cut away view of a calciner showing a pattern of mixers on the interior of the calciner.

In utilizing the lifter of the invention, a group of lifters are positioned in a pattern on the interior of kiln 18 as shown in FIG. 1. The face plates 32 of lifters 10 are inclined back from the direction of kiln rotation so that the front surfaces 38 of face plates 32 contact particulate material being calcined.

A lifter in accordance with the invention is fabricated of a weldable alloy adapted to withstand the severe operating conditions. In a commercial kiln, the base plate 12 might be an eight inch diameter circle of one inch thickness, the anchor post 20 a 2.5 inch diameter rod, the face plate 32 about one square foot of one inch plate, the gussets 34 and 36 might be equilateral triangles of one inch plate, and the sole plate 24 a one inch plate about 20 by 12 inches. The bottom of sole plate 24 overlies the top of refractory lining (not shown) between the kiln shell and the bottom of sole plate 24.

EXAMPLE 1

In this example, lifters substantially as described above and shown in FIGS. 2 and 3 were installed in a commercial coke calcining kiln. After three months of continuous operation, the kiln interior was inspected, and the lifters showed no significant degradation. Conventional cast refractory lifters in similar circumstances typically exhibit significant degradation.

I claim:

1. A fabricated steel alloy lifter for enhancing the mixing of the contents of a rotating calcining kiln, said lifter comprising:

a base plate adapted for fixed attachment to an inner surface of a shell of said kiln;

an anchor post attached to said base plate and extending upwardly therefrom;

a sole plate affixed to the upper end of said anchor post and oriented in a plane substantially parallel to the plane of said base plate;

a face plate affixed to said sole plate and extending upwardly therefrom forming an acute angle between said face plate and said sole plate; and at least one support member attached to said face plate and said sole plate, said support member being adapted to maintain the orientation of said face plate relative to said sole plate.

2. A fabricated lifter as defined in claim 1 wherein said at least one support member includes a pair of gussets affixed to the top of said sole plate and to the underside of said face plate.

3. A fabricated lifter as defined in claim 2 wherein said gussets are positioned between the outer edges of said face plate and the outer diameter of said anchor post.

4. A fabricated lifter as defined in claim 3 wherein said face plate is attached to an end of said sole plate adjacent the connection of said sole plate and said anchor post, and said face plate extends from said end of said sole plate back over said anchor post whereby said face plate and said gussets shield the top of said anchor post from radiant heat.

5. In a refractory lined rotating kiln for calcining particulate solid material, the improvement wherein:

said kiln includes a plurality of fabricated steel lifters spaced about at least a portion of said kiln, said lifters each including a base plate affixed to an inner surface of said kiln, an anchor post attached to said base plate and extending upwardly therefrom, a sole plate affixed to the upper end of said anchor post and oriented in a plane substantially parallel to the plane of said base plate, a face plate affixed to said sole plate and extending upwardly therefrom forming an acute angle between said face plate and said sole plate, and a pair of gussets affixed to the top of said sole plate and to the underside of said face plate.

* * * * *

UNITED STATES PATENT AND TRADEMARK OFFICE

CERTIFICATE OF CORRECTION

PATENT NO. : 5,975,752
DATED : November 2, 1999
INVENTOR(S) : Brian J. Doerksen

It is certified that error appears in the above-identified patent and that said Letters Patent is hereby corrected as shown below:

In the drawings, Sheet 1, Figure 2, the lead line and arrow extending from reference numeral 12 should point to the base plate attached to kiln shell 16 and not to the weld which attaches the base plate to the kiln shell, as follows:

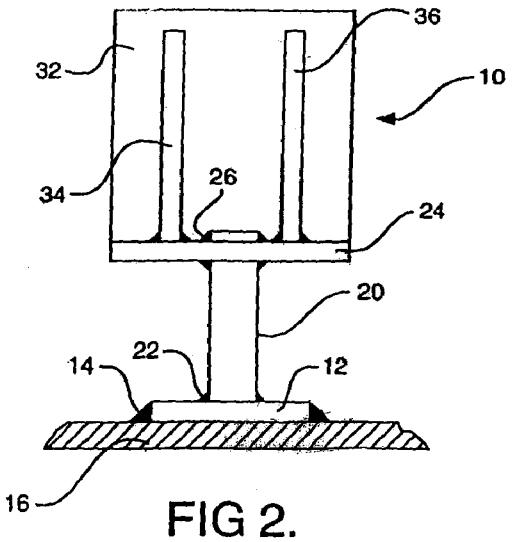

FIG 2.

UNITED STATES PATENT AND TRADEMARK OFFICE

CERTIFICATE OF CORRECTION

PATENT NO. : 5,975,752
DATED : November 2, 1999
INVENTOR(S) : Brian J. Doerksen

It is certified that error appears in the above-identified patent and that said Letters Patent is hereby corrected as shown below:

In the drawings, Sheet 2, Figure 3, add reference numeral -- 33 -- and a lead line and arrow extending from reference numeral 33 and pointing to the weld between face plate 32 and the short section of the sole plate 28, as follows:

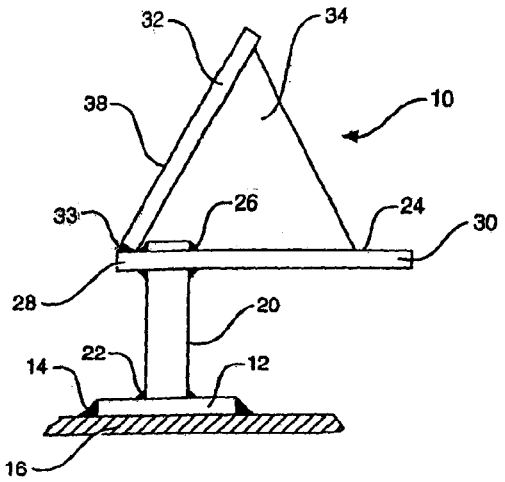

FIG 3.

Column 2,
Line 9, delete reference numeral "34" and replace it with reference numeral -- 33 --.

Signed and Sealed this

First Day of July, 2003

JAMES E. ROGAN
*Director of the United States Patent and Trademark Office*